United States Patent [19]

Moss

[11] 4,085,476

[45] Apr. 25, 1978

[54] MOP CONSTRUCTIONS AND METHOD OF MAKING SAME

[75] Inventor: Theron V. Moss, Cleveland, Tenn.

[73] Assignee: South Eastern Cordage Company, Cleveland, Tenn.

[21] Appl. No.: 602,149

[22] Filed: Aug. 5, 1975

[51] Int. Cl.[2] ..... A47L 13/12; A47L 13/20

[52] U.S. Cl. ..... 15/229 A; 15/118; 300/21

[58] Field of Search ..... 15/115, 116 R, 119 R, 15/120 R, 147 R, 147 A, 229 R, 229 A, 229 AP, 229 AC, 229 B, 229 BP, 229 BC; 300/21

[56] References Cited

U.S. PATENT DOCUMENTS

| | | | |
|---|---|---|---|
| 1,542,108 | 6/1925 | Taylor | 300/21 X |
| 1,625,857 | 4/1927 | Jumonville | 300/21 |
| 2,983,941 | 5/1961 | Beyer-Olsen | 15/230.13 |
| 3,336,620 | 8/1967 | Moss | 15/229 A |
| 3,633,975 | 1/1972 | Argeris | 15/229 R X |
| 3,696,460 | 10/1972 | Moss | 15/229 R |
| 3,795,934 | 3/1974 | Moss | 15/229 A |
| 3,962,743 | 6/1976 | Moss | 15/229 AP |

FOREIGN PATENT DOCUMENTS

| | | | |
|---|---|---|---|
| 678,157 | 1/1964 | Canada | 184/102 |
| 131,853 | 3/1949 | Australia | 15/229 AC |

*Primary Examiner*—Daniel Blum

*Attorney, Agent, or Firm*—Maky, Renner, Otto & Boisselle

[57] ABSTRACT

Mops formed by laying down one or more cords of yarn in a continuous manner back and forth so that the cords extend generally transversely from one side to the other to form looped ends along the opposite side edges thereof. The cords are secured together in the desired relation by two or more rows of stitching extending lengthwise parallel to the side edges of cord material. Afterwards, the cord material may be cut to any desired length, and the ends of the length of cord material may either be connected together to form a closed loop of cord material, or the ends of the cord material may be left free as desired. A headband may be attached to the cord material anywhere along the length thereof if formed into a loop, or if the ends of the cord material are left free, such headband may be attached to the cord material intermediate the ends thereof or at one end thereof.

31 Claims, 18 Drawing Figures

MOP CONSTRUCTIONS AND METHOD OF MAKING SAME

This invention relates generally as indicated to mop constructions and method of making same which are relatively inexpensive, quite versatile, and of a rugged construction affording relatively long mop life.

The mop constructions of the present invention are desirably made from one or more cords of yarn which are laid substantially flat in a continuous manner back and forth so that the cords extend generally transversely from one side to the other to form looped ends along the opposite side edges thereof. The cords are then secured together in the desired relation by two or more rows of stitching extending lengthwise of the mop parallel to the side edges of the cord material.

The cord material with rows of stitching applied thereto, once formed, may be cut to any desired length, and the ends of the cord material may either be connected together to form a closed loop or left free as desired. Afterwards, either a headband or connector of suitable type may be attached thereto, depending on the particular use to be made of the mop.

If the mop is to be used as a wet mop, a fabric headband, preferably made of an open scrim material, may be wrapped around the cord material and stitched thereto in known manner. Alternatively, a specially formed headband may be made by first folding the headband material from one end to the middle and then folding the other end over the first folded end, followed by folding the headband material in the center with the other end on the inside and placing the same either over a fold on the yarn material or over one or both ends of the yarn material and stitching the headband to the mop cords. The stitching is desirably located in spaced relation from the folded ends of the headband so that the folded ends of the headband will curl outwardly to protect against the mop handle attached thereto from knocking on the floor or against other objects.

In still another form of the invention, the length of cord material may be provided with a fabric backing preferably extending the entire length of the cord material. Alternatively, the fabric backing may be provided only at the ends of the cord material. In either case, the ends of the cord material may be brought together with the fabric backing on the inside, and then turned back and stitched together to form the headband. Providing the fabric backing along the entire length of the cord material gives the mop a little more body, and also facilitates sewing the fabric backing automatically onto the cord material and making the headband simply by turning the ends of the cord material back and stitching the ends together. The stitching may run across the entire width of the headband, but is preferably confined to the sides of the headband to permit one of the jaws of the handle attachment device to be inserted inside the headband to protect against the handle attachment device from knocking on the floor or against furniture and the like during use of the mop.

The mop may also conveniently be used as a dust mop simply by attaching a plastic handle connector to a closed loop of the cord material anywhere along the length thereof, but preferably in the region where the ends of the cord material are connected together.

With the mop formed as thus described, there are no loose ends of yarn to become unraveled or frayed, thereby minimizing the amount of lint produced by the mop and also greatly enhancing the mop life. Also, tangling of the individual mop yarns or cords is completely eliminated, and the amount and type of yarn material used to make the mop may readily be controlled to control the absorbency of the mop, and other properties. Such a mop may also readily be shaken out or laundered without producing a large quantity of lint, and because the cords are maintained in the desired relation extending generally transversely of the side edges of the mop, the cords will not leave a streaked appearance during use.

It is accordingly a principal object of this invention to provide a mop construction and method of making same in which the individual cords are oriented in a particular manner to prevent tangling of the cords and streaking of the floor by the cords during use.

Another object is to provide such a mop construction and method of manufacture in which there are very few cut ends to become frayed and unraveled during use or produce lint when used or washed.

Still another object is to provide, in one form of the invention, a novel headband for the mop including outwardly curled ends to protect against knocking on the floor and other objects by the mop handle.

Yet another object is to provide, in another form of the invention, a mop which has a fabric backing either extending over the entire length of the cord material or located only at the ends thereof, bringing the ends of the cord material together with the fabric backing on the inside, and turning the ends back and stitching them together to form the headband.

Still another object is to provide a novel headband for the mop in which one of the jaws of the handle attachment device is received inside the headband to protect against the handle attachment device from knocking on the floor or against furniture and the like during use of the mop.

Other objects, advantages, and features of this invention will become apparent to those skilled in the art upon a reading of the following more detailed description of the invention.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
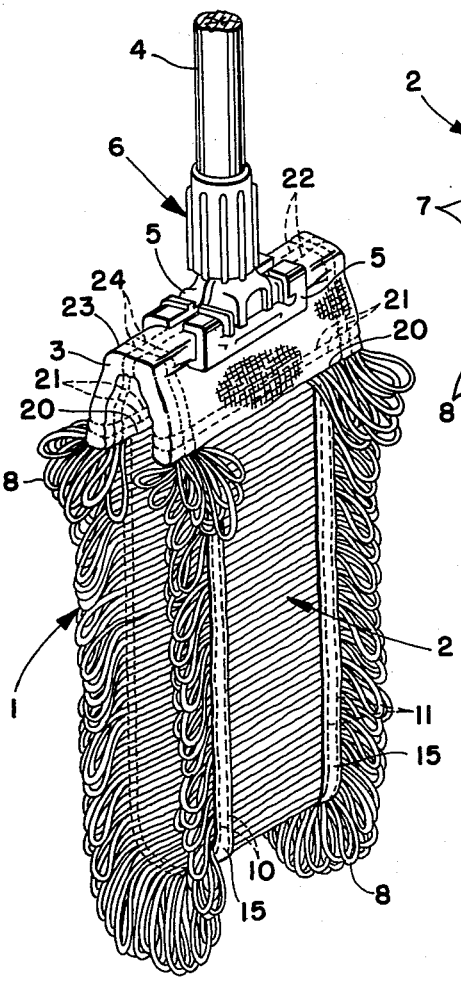
FIG. 1 is an isometric view of one form of mop constructed in accordance with the present invention.

Referring now in detail to the drawings and initially to FIG. 1 thereof, there is shown one form of mop 1 in accordance with the present invention, including a length of cord material 2 and a headband 3 encircling same. A mop handle 4 is also shown attached to the mop as by folding the headband 3 and inserting same between the jaws 5 of a suitable handle attachment device 6.

Figure 2:
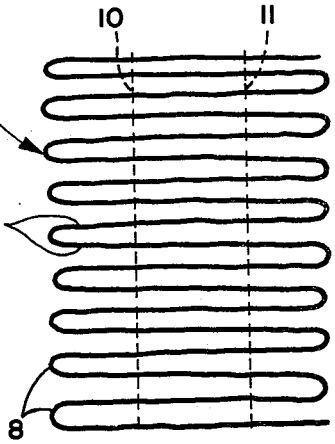
FIGS. 2 and 3 are enlarged fragmentary semi-diagrammatic views illustrating the various preliminary steps in the manufacture of the mop of FIG. 1.
Figure 3:
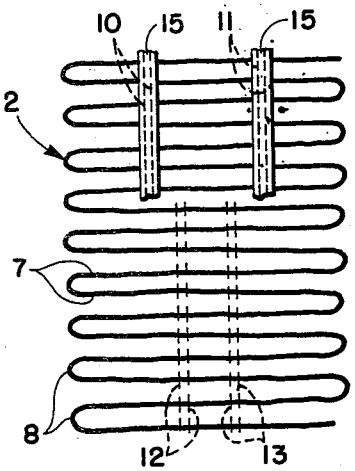

The length of cord material 2 is desirably made from one or more cords of yarn which are laid substantially flat in a continuous manner back and forth to provide plural mop cords 7 extending generally transversely from one side to the other to form looped ends 8 along the opposite side edges thereof as schematically illustrated in FIGS. 2 and 3. The looped yarn may be formed, for example, as by wrapping the yarn in spiral fashion around the outer runs of a pair of endless conveyor chains as shown and described in U.S. Pat. No. 3,696,460, or the yarn may be laid down by a traversing loop roller type of mechanism which moves back and forth transversely of a suitable support member to deposit the loops thereon. Of course, it will be understood that the yarn used may be of various types and sizes and of various densities, and both single and multiple layers of yarn may also be utilized as desired.

As the looped yarn is laid down, the plural mop cords 7 may be secured together in the desired relation by two or more rows 10 and 11 of stitching extending lengthwise of the mop parallel to the side edges of the cord material. In FIG. 2, two such rows 10 and 11 of stitching are provided, one adjacent each side edge of the cord material, with the rows of stitching spaced inwardly from the loop ends 8 so that the looped ends extend outwardly beyond the rows of stitching, for example, two to four inches.

Of course, more than one row of stitching may be placed adjacent each side edge of the cord material, not only to assist in maintaining the mop cords in the desired relationship, but also to give the cord material more body, that is, enhance the stiffness of the mop. See, for example, FIG. 3 wherein there are two closely spaced rows 10 and 11 of stitching adjacent each side edge of the cord material. Also in FIG. 3 there are shown two intermediate rows 12 and 13 of stitching, each of which may consist of one or more closely spaced rows of stitching to further enhance the stiffness of the mop. Two such closely spaced rows 12 and 13 are shown. As apparent, the rows of stitching 10 through 13 may pass directly through the cords 7 themselves or through tapes 15 placed on the cords as further shown in FIG. 3; that is, the cords may be stitched together either with or without the use of tapes.

Figure 4:
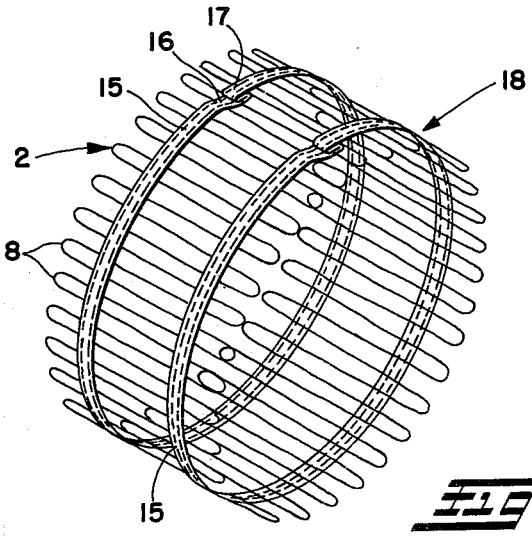
FIG. 4 is an enlarged semi-diagrammatic view showing the manner in which the ends of the cord material of FIGS. 1 and 2 may be attached together to form a closed loop.
Figure 6:
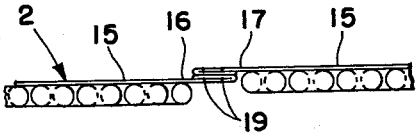
FIG. 6 is a fragmentary side elevation view of the connected ends of the cord material of FIG. 5, as seen from the plane of the line 6—6 thereof.
Figure 5:
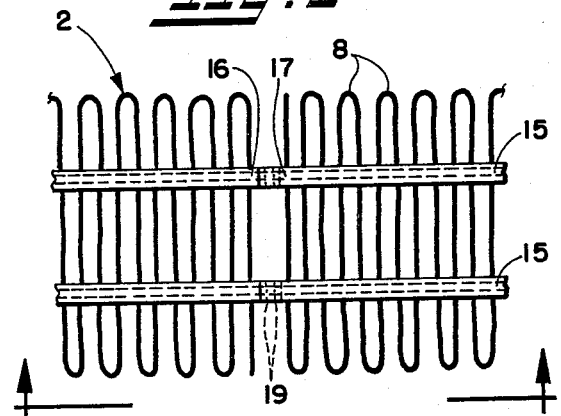
FIG. 5 is an enlarged fragmentary semi-diagrammatic view of the overlapping ends of the length of cord material of FIG. 4.
Figure 4A:
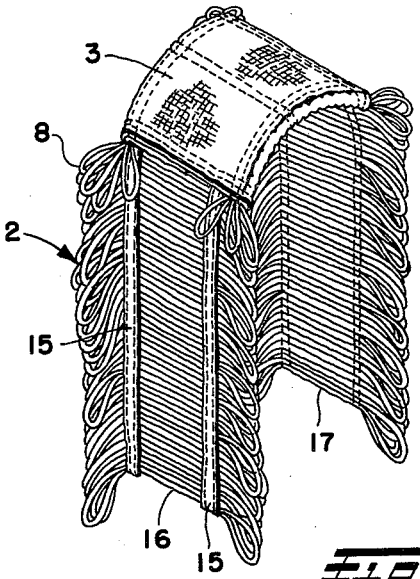
FIG. 4A is an enlarged semi-diagrammatic view showing a length of cord material which has been folded without connecting the ends together.

The cord material 2 with the mop cords 7 secured together by the rows of stitching applied thereto, once formed, may be cut to any desired length, and the ends 16, 17 of the cord material may either be left loose as shown in FIG. 4A or brought together and tacked to form a closed loop 18 as shown, for example, in FIG. 4. To form the cord material 2 into a closed loop, the ends 16, 17 of the cord material or tape 15 ends as the case may be are desirably folded back on themselves and the ends are overlapped and then stitched together or tacked as shown at 19 in FIGS. 5 and 6.

The advantage in forming the cord material 2 into a closed loop 18 is that it eliminates any loose ends which might otherwise become frayed or unravel or become snagged during use. Another advantage is that the closed loop in effect provides a double layer of cord material for greater absorbency and better appearance, with the tapes 15, if used, on the outside on both sides of the mop.

The headband 3 illustrated in FIG. 1 may be formed simply by wrapping a strip of the headband material one or more times around the length of cord material 2 and stitching the headband material to the cord material using a suitable lock or chain stitch passing entirely through the cords and headband material. As the headband material 3 is wrapped around the cord material 2, the looped ends 8 of the cord material in the region of the headband 3 are desirably bunched together and laid flat to extend longitudinally from the ends 20 of the headband as further shown in FIG. 1 prior to stitching the headband to the cord material. Preferably, two transverse rows 21 of stitching are provided at the ends 20 of the headband 3 which extend across the entire width of the headband, and two additional transverse rows 22 of stitching are provided between the two transverse rows intermediate the ends of the headband. In addition, the headband is also desirably stitched along both sides 23 of the headband using two rows 24 of stitching adjacent each side which extend across the transverse rows 21, 22 of stitching to lock the threads in the transverse rows from being pulled out at the sides.

While many different materials may be used for the headband, 3, the headband is desirably of an open scrim material which is highly wear-resistant and also desirably sufficiently abrasive to permit the headband to be used for removing scuff marks and other hard-to-remove dirt marks from the floor or other surfaces being cleaned. A nylon scrim material is preferred, but it will be apparent that other materials may also be used for the scrim material, including polyethylene, polyester, polypropylene, and rayon. The use of open scrim material for the headband also has the advantage that it allows the headband and mop cords therebeneath to be washed out cleanly and dried quickly due to the openings therein, regardless of whether the headband is relatively short or long.

If the headband 3 is relatively long, the headband may be folded intermediate its length as shown in FIG. 1 for insertion between the jaws 5 of a suitable attachment device 6 which may be of the type shown and described in U.S. Pat. No. 3,605,161, granted Sept. 20, 1971.

If the cord material 2 is made in the form of a closed loop 18 as shown in FIG. 4, the headband 3 of FIG. 1 may be attached to the mop anywhere along the length of the cord material. However, the headband is preferably located where the ends 16, 17 of the cord material 2 are brought together to provide protection against the ends of the closed loop 18 from being pulled apart during use, and indeed, even to eliminate the need for having to tack the ends of the cord material together as previously described. Of course, if the ends of the cord material are to be left free, the headband 3 should be located intermediate the ends 16, 17 of the cord material 2 as shown in FIG. 4A.

Figure 7:
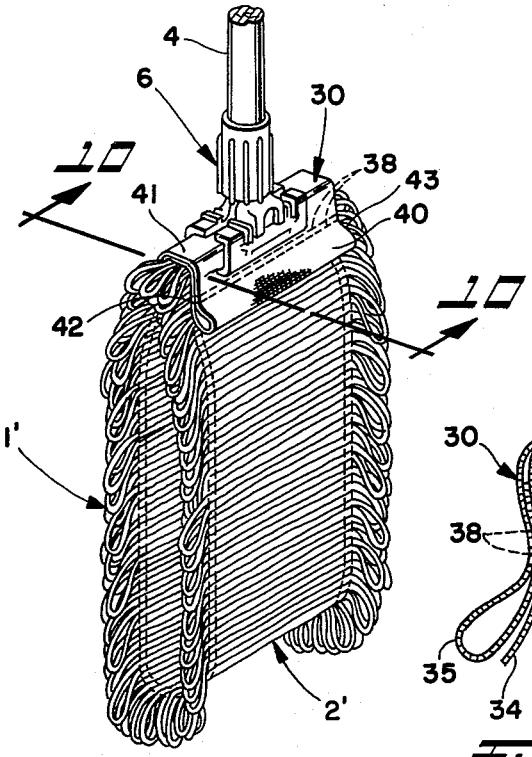
FIG. 7 is an isometric view of a mop similar to that shown in FIG. 1 but having a different type headband and showing one form of handle attached thereto.
Figure 8:
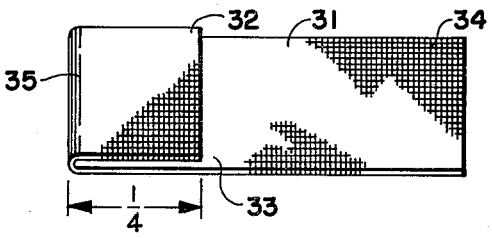
FIGS. 8 and 9 are semi-diagrammatic views illustrating the procedure for folding the headband of FIG. 7 prior to attachment to the mop.
Figure 9:
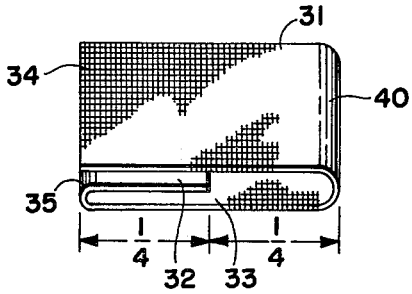
Figure 10:
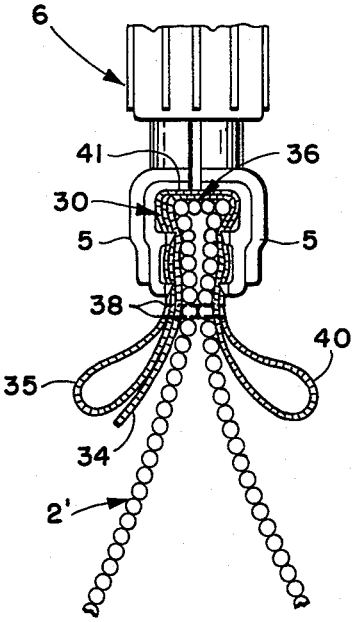
FIG. 10 is a fragmentary longitudinal section through the headband and mop of FIG. 7, taken on the plane of the line 10—10 thereof.

In FIG. 7 there is shown a mop 1' similar to the mop 1 of FIG. 1 but with a different form of headband 30 which is desirably first formed by folding the headband material 31 from one end 32 to the middle 33 as shown in FIG. 8, and then the other end 34 is folded over and brought into alignment with the first fold 35 as shown in FIG. 9. Next the folded headband material 31 is further folded in the center 33 with the end 34 on the inside of the fold and placed over a fold 36 of the cord material 2' and stitched thereto as shown in FIGS. 7 and 10. The stitching desirably consists of one or more rows 38 of stitching spaced from the folded ends 35, 40 of the headband material and the center fold 41, with the stitching 38 extending through both sides of the headband material 31 and the double layer of cord material 2' therebetween. During the stitching operation, each row 38 of stitching is started from one edge 42 and desirably initially stitched about an inch and then backed up and then continued on again to secure the row of stitching to the headband. At the other edge 43, the back stitching process is repeated to insure against pull-out of each row of stitching.

Providing one or more rows 38 of stitching across the headband 30 as previously described causes the folded ends 35, 40 of the headband to curl outwardly as shown in FIGS. 7 and 10 to protect against the handle attachment device 6 from knocking on the floor or against furniture and the like when a mop handle 4 is secured to the mop headband 30 as further shown in the drawings.

Figure 11:
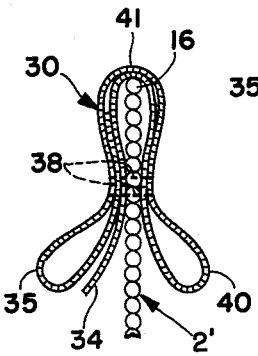
FIG. 11 is a fragmentary longitudinal section through a headband substantially the same as that shown in FIGS. 7 and 10 but shown attached to one end only of the mop cord material like that shown in FIGS. 2 and 3.

As with the headband 3 of FIG. 1, if the cord material 2 or 2' is formed into a closed loop 18 as shown in FIG. 4, the headband 30 of FIG. 7 may be secured to the cord material at a fold anywhere along its length, but it is advantageous to secure the headband to the ends of the cord material for the same reasons previously discussed. Of course, if the ends 16, 17 of the cord material 2 or 2' are to be left free, the cord material may be folded intermediate its ends and the headband 30 attached thereto at a center fold 36 as illustrated in FIG. 10. Alternatively, the headband 30 of FIGS. 7 and 10 may be attached to either end 16, 17 of a single layer of cord material 2' by folding such headband over one end 16, for example, and stitching the same thereto as shown in FIG. 11. It will also be apparent that the headband 30 shown in FIGS. 7, 10 and 11 could be used equally well in a mop arrangement wherein the mop cords extend substantially longitudinally of the mop, as shown, for example, in U.S. Pat. Nos. 3,644,958 and 3,795,934.

Figure 12:
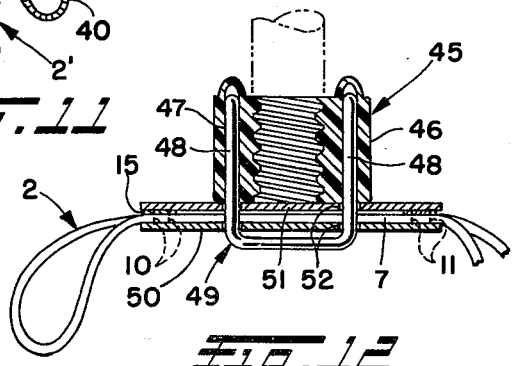
FIG. 12 is a fragmentary transverse section through another mop in accordance with this invention showing another form of handle attachment device connected thereto.
Figure 13:
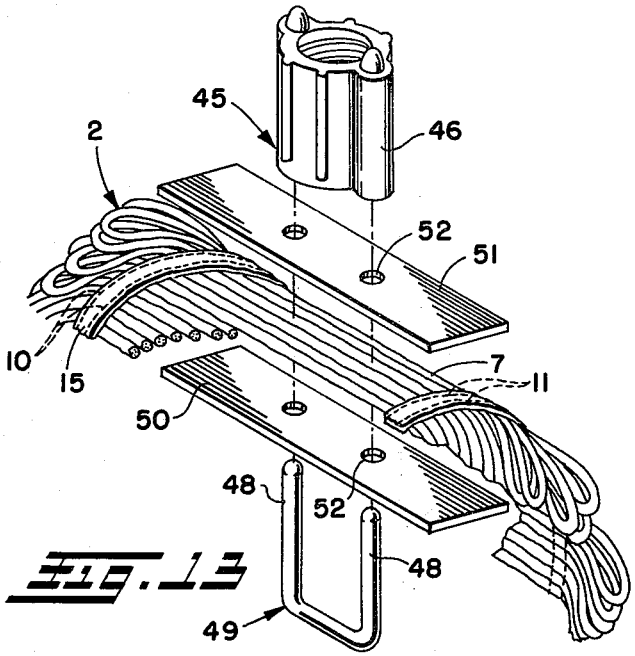
FIG. 13 is an enlarged fragmentary exploded isometric view of the handle attachment device of FIG. 12.

With a headband 3 or 30 applied to the cord material 2 or 2' as previously described, the mop is primarily designed for used as a wet mop. However, if in place of the headband, the cord material 2 or 2' is provided with a handle connector 45 of the type shown, for example in FIGS. 12 and 13, the mop may be used equally well as either a wet mop or a dry mop. The handle connector 45 shown consists of a tubular handle socket member 46 having a pair of holes 47 therein for receipt of the ends 48 of a generally U-shape member 49 after passing such ends through a plurality of the mop cords 7 intermediate the rows 10 and 11 of stitching. Two pieces 50, 51 of flat plastic strip of strapping of polyvinyl or polyethylene, one on each side of the cord material 7 between the tapes 15 or rows of stitching 10 and 11, may be used in conjunction with the U-shape member 49 to help support the cord material and minimize the contact between the U-shape member and the floor during use of the mop. Both strips 50 and 51 are provided with two holes 52 therein for receipt of the ends of the U-shape member and passage through the cord material prior to attachment to the handle connector.

Figure 14:
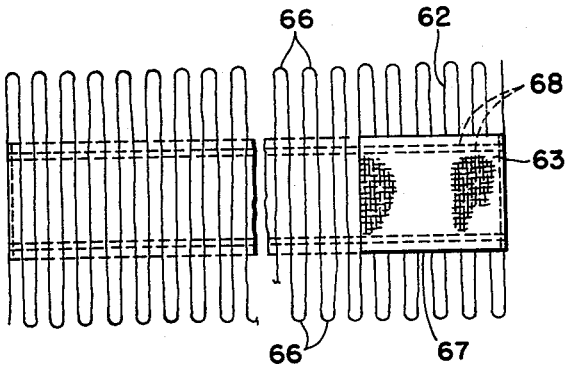
FIG. 14 is a fragmentary semi-diagrammatic view illustrating a modified form of cord material for use in the manufacture of still another form of mop in accordance with this invention.
Figure 15:
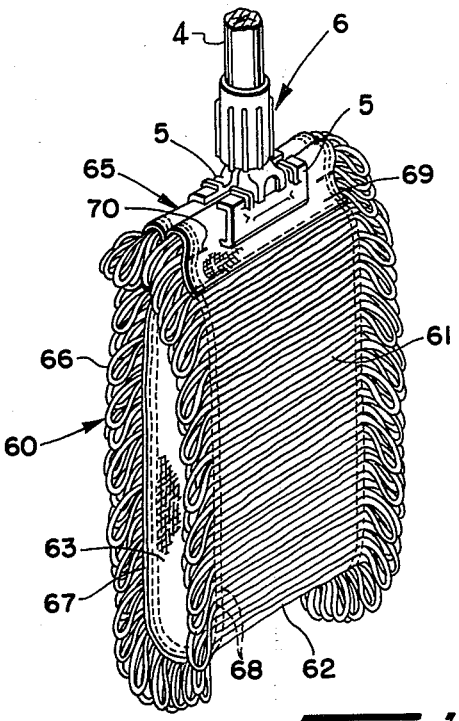
FIG. 15 is an isometric view of such other form of mop made from the cord material of FIG. 14.

In FIG. 15 there is shown still another form of mop 60 in accordance with this invention, which is quite similar to the mop shown in FIGS. 1 and 7 except that the length 61 of cord material 62 has a fabric backing 63 secured thereto to facilitate making of the headband 65, in a manner to be subsequently described. The cord material 62 may be laid substantially flat in a continuous manner back and forth across the fabric strip backing 63 to form looped ends 66 extending outwardly beyond the side edges 67 of the fabric, for example, two to four inches, and the cord material may be automatically sewn onto the fabric strip backing 63 by one or more rows of stitching 68 adjacent each side edge, as schematically shown in FIG. 14.

Afterwards, the length of cord material 61 with fabric backing 63 may be cut to any desired length, and the ends 69 of the cord material may be brought together with the fabric backing on the inside, and the ends turned back approximately two to four inches and stitched together to form the headband 65 for the mop in the manner shown in FIG. 15.

One or more rows of stitching 70 may be used to secure the turned back ends 69 of the cord material together, and the stitching may also extend across the entire width of the headband if desired. However, the turned back ends 69 of the headband 65 are preferably only stitched together adjacent the side edges 67 of the fabric backing, whereby the headband 65 may either be inserted in conventional manner between the two jaws 5 of a handle attachment device 6 as shown in FIG. 15, or one of the jaws 5 of the handle attachment device 6 may be received in the pocket 72 formed by the stitched ends 69 of the headband as shown in FIG. 16 to protect against such one jaw of the handle attachment device from knocking on the floor or against furniture and the like during use of the mop.

Figure 16:
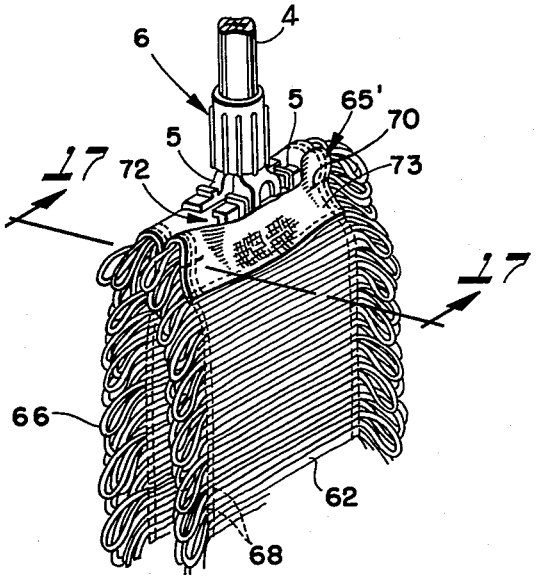
FIG. 16 is a fragmentary isometric view of still another form of mop in accordance with this invention.
Figure 17:
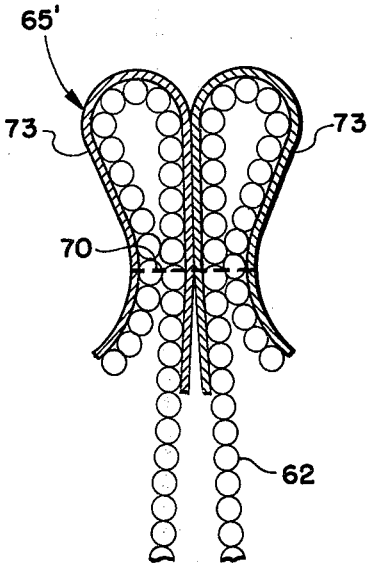
FIG. 17 is a fragmentary section through the headband of FIG. 16, taken on the plane of the line 17—17 thereof.

Also, while it is preferred that the fabric backing 63 run the entire length of the cord material to facilitate sewing of the cord material to the fabric backing automatically, and also to give more body to the mop, it will be apparent that shorter strips 73 of fabric backing need only be attached to the ends 74 of the length of cord material and it is still possible to bring the ends of the cord material together and fold the ends back and stitch them together to form a headband 65' as shown, for example, in FIGS. 16 and 17. Of course, if the fabric backing 63 does not extend the full length of the cord material, the plural mop cords should still desirably be secured together in the desired relation as by two or more rows of stitching 68 extending lengthwise of the mop parallel to the side edges of the cord material as shown in FIG. 16 and previously described particularly with reference to FIGS. 2 and 3.

The embodiments of the invention in which an exclusive property or privilege is claimed are defined as follows:

1. A mop construction comprising a mop head consisting of a length of cord material, said cord material comprising one or more cords of yarn extending in a substantially continuous manner back and forth to provide plural mop cords extending generally transversely from one side of said mop head to the other to form loops of cord material along the opposite side edges of said mop head over a predetermined length, plural rows of stitching extending lengthwise of said mop head toward the ends of the length thereof parallel to the side edges thereof for securing said mop cords together, means for securing the ends of said mop head together to form a closed loop completely open in the center with said loops of cord material along the opposite side edges thereof, and means attached to said cord material at one point along the circumference of said closed loop extending transversely thereof providing for attachment of said cord material to a handle.

2. The mop construction of claim 1 wherein there are at least two rows of stitching, one adjacent each side edge of said mop head, with the rows of stitching spaced inwardly from said loops of cord material.

3. The mop construction of claim 2 wherein there are plural rows of stitching adjacent each side edge of said mop head with the rows of stitching spaced inwardly from said loops of cord material.

4. The mop construction of claim 3 further comprising additional rows of stitching intermediate said plural rows of stitching to enhance the stiffness of said mop head.

5. The mop construction of claim 1 further comprising tapes for the plural rows of stitching.

6. The mop construction of claim 1 further comprising tapes extending lengthwise of said mop head, said plural rows of stitching extending through said tapes and cords to secure said cords to said tapes, said tapes being on the outside of said closed loop.

7. The mop construction of claim 1 wherein said means connected to said cord material providing for attachment of said cord material to a handle comprises a headband secured to said cord material at such one point along the circumference of said closed loop.

8. The mop construction of claim 7 wherein said headband is secured to both ends of said mop head to form said closed loop.

9. The mop construction of claim 1 wherein said means connected to said cord material providing for attachment of said cord material to a handle comprises a handle connector secured to said cord material along the length thereof.

10. The mop construction of claim 9 wherein said connector comprises a tubular handle socket having a pair of holes therein, and a generally U-shape member having end portions which extend through said cord material into said holes in said tubular handle socket.

11. The mop construction of claim 10 wherein said handle connector further comprises two flat strips, one on each side of the cord material, said flat strips having aligned holes therein for receipt of the ends of said U-shape member and passage through said cord material.

12. A method of making a mop head comprising the steps of placing one or more cords of yarn in a substantially continuous manner back and forth to provide plural mop cords extending generally transversely from one side of the mop head to the other to form loops of cord material along the opposite side edges of the mop head over a predetermined length, securing said mop cords together by stitching said cords along plural rows extending lengthwise of the mop toward the ends of the length thereof for securing said mop cords together to provide a length of cord material, cutting the cord material to the desired length, securing the ends of the mop head together to form a closed loop completely open in the center with such loops of cord material along the opposite side edges thereof, and providing means at one point along the circumference of the closed loop extending transversely thereof for attachment to a handle.

13. The method of claim 12 wherein, during the stitching of the mop cords together, tapes are applied to the cords, and the stitching is caused to extend through the tapes and cords to secure the cords to the tapes with the tapes on the outside of the closed loop.

14. The method of claim 12 wherein the means connected to the cord material providing for attachment of the cord material to a handle comprises a headband secured to the cord material at such one point along the circumference of such closed loop.

15. The method of claim 12 wherein the means connected to the cord material providing for attachment of the cord material to a handle comprises a handle connector which is secured to the cord material along the length thereof, such handle connector comprising a tubular handle socket having a pair of holes therein, a generally U-shape member having end portions which extend through the cord material into the holes in the tubular handle socket, and a pair of flat strips, one on each side of the cord material, such flat strips having aligned holes therein which receive the ends of the U-shape member and the ends of the U-shape member passed through the cord material therebetween.

16. A mop construction comprising a mop head consisting of a length of cord material, and means connected to said cord material providing for attachment of said cord material to a handle, said cord material comprising one or more cords of yarn extending in a substantially continuous manner back and forth to provide plural mop cords extending generally transversely from one side of said mop head to the other to form loops of cord material along the opposite side edges of said mop head over a predetermined length, and plural rows of stitching extending lengthwise of said mop head toward the ends of the length thereof parallel to the side edges thereof for securing said mop cords together, said means connected to said cord material providing for attachment of said cord material to a handle comprising a headband secured to said cord material, said headband consisting of a strip of headband material wrapped in a direction parallel to the transversely extending mop cords around the opposite side edges of said mop head including the loops of cord material in the region of said headband, said headband being stitched to said cord material.

17. The mop construction of claim 16 wherein said headband is secured to said cord material intermediate the ends thereof, and the ends of said mop head are free, said loops of cord material being along the opposite side edges of said mop head from one free end to the other.

18. The mop construction of claim 16 wherein said headband is secured to one end of said mop head, leaving the other end of said mop free, with said loops of cord material along the opposite side edges of said mop head from one end to the other.

19. A mop construction comprising a mop head consisting of a length of cord material, and means connected to said cord material providing for attachment of said cord material to a handle, said cord material comprising one or more cords of yarn extending in a substantially continuous manner back and forth to provide plural mop cords extending generally transversely from one side of said mop head to the other to form loops of cord material along the opposite side edges of said mop head over a predetermined length, plural rows of stitching extending lengthwise of said mop head toward the ends of the length thereof parallel to the side edges thereof for securing said mop cords together, and means for securing the ends of said mop head together to form a closed loop with said loops of cord material along the opposite side edges thereof, and tapes extending lengthwise of said mop head, said plural rows of stitching extending through said tapes and cords to secure said cords to said tapes, said tapes being on the outside of said closed loop, the ends of said tapes being folded back on each other, and said ends being overlapped and stitched together to form said closed loop.

20. A mop construction comprising a mop head consisting of a length of cord material, and means connected to said cord material providing for attachment of said cord material to a handle, said cord material comprising one or more cords of yarn extending in a substantially continuous manner back and forth to provide plural mop cords extending generally transversely from one side of said mop head to the other to form loops of cord materal along the opposite side edges of said mop head over a predetermined length, plural rows of stitching extending lengthwise of said mop head toward the ends of the length thereof parallel to the side edges thereof for securing said mop cords together, and means for securing the ends of said mop head together to form a closed loop with said loops of cord material along the opposite side edges thereof, said means connected to said cord material providing for attachment of said cord material to a handle comprising a headband secured to said cord material, said headband consisting of a strip of headband material wrapped in a direction parallel to the transversely extending mop cords around the opposite side edges of said mop head including the loops of cord material in the region of said headband, said headband being stitched to said cord material.

21. A mop construction comprising a mop head consisting of a length of cord material, and means connected to said cord material providing for attachment of said cord material to a handle, said cord material comprising one or more cords of yarn extending in a substantially continuous manner back and forth to provide plural mop cords extending generally transversely from one side of said mop head to the other to form loops of cord material along the opposite side edges of said mop head over a predetermined length, plural rows of stitching extending lengthwise of said mop head toward the ends of the length thereof parallel to the side edges thereof for securing said mop cords together, and means for securing the ends of said mop head together to form a closed loop with said loops of cord material along the opposite side edges thereof, said means connected to said cord material providing for attachment of said cord material to a handle comprising a headband secured to said cord material, said headband consisting of a strip of headband material having folded ends, said headband also being folded intermediate said folded ends with a portion of said cord material inserted therebetween, and stitching extending through both sides of said headband and the cord material therebetween, said stitching being spaced from said folded ends, whereby said folded ends curl outwardly to protect against a handle attachment to said headband from knocking against furniture and the like.

22. A mop construction comprising a mop head consisting of a length of cord material, and means connected to said cord material providing for attachment of said cord material to a handle, said cord material comprising one or more cords of yarn extending in a substantially continuous manner back and forth to provide plural mop cords extending generally transversely from one side of said mop head to the other to form loops of cord material along the opposite side edges of said mop head over a predetermined length, plural rows of stitching extending lengthwise of said mop head toward the ends of the length thereof parallel to the side edges thereof for securing said mop cords together, and means for securing the ends of said mop head together to form a closed loop with said loops of cord material along the opposite side edges thereof, said cord material having a fabric backing, the ends of said cord material being connected together to form a closed loop with said fabric backing on the inside of said closed loop, said ends of said mop head being turned back and secured together to expose the ends of said fabric backing which form a headband for said mop head.

23. The mop construction of claim 22 wherein the turned back ends of said cord material are secured together adjacent the sides only of said fabric backing to provide a pocket between the turned back ends for receipt of a portion of a handle attachment device therebetween.

24. The mop construction of claim 22 wherein said fabric backing extends the entire length of said cord material.

25. The mop construction of claim 22 wherein said fabric backing is located only at the ends of said cord material.

26. A method of making a mop head comprising the steps of placing one or more cords of yarn in a substantially continuous manner back and forth to provide plural mop cords extending generally transversely from one side of the mop head to the other to form loops of cord material along the opposite side edges of the mop head over a predetermined length, securing said mop cords together by stitching said cords along plural rows extending lengthwise of the mop toward the ends of the length thereof for securing said mop cords together to provide a length of cord material, cutting the cord material to the desired length, securing the ends of the mop head together to form a closed loop with such loops of cord material along the opposite side edges thereof, and securing a headband to the cord material for attachment to a handle, said headband consisting of a strip of headband material which is wrapped in a direction parallel to the transversely extending mop cords around the opposite side edges of the mop head including the loops of cord material in the region of the headband, and stitched to the cord material.

27. A method of making a mop head comprising the steps of placing one or more cords of yarn in a substantially continuous manner back and forth to provide plural mop cords extending generally transversely from one side of the mop head to the other to form loops of cord material along the opposite side edges of the mop head over a predetermined length, securing said mop cords together by stitching said cords along plural rows extending lengthwise of the mop toward the ends of the length thereof for securing said mop cords together to provide a length of cord material, cutting the cord material to the desired length, securing the ends of the mop head together to form a closed loop with such loops of cord material along the opposite side edges thereof, and securing a headband to the cord material for attachment to a handle, said headband consisting of a strip of headband material which is formed by folding the headband material from one end to the middle, then folding the other end over the first folded end and bringing it into alignment with the first fold, next folding the headband material further in the center with the last folded end on the inside of the fold and a portion of the cord material inserted therebetween, and stitching both sides of the headband and the cord material therebetween together with the stitching spaced from the folded ends to permit the folded ends to curl outwardly to protect against a handle attachment to the headband from knocking against furniture and the like.

28. A method of making a mop head comprising the steps of placing one or more cords of yarn in a substantially continuous manner back and forth to provide plural mop cords extending generally transversely from one side of the mop head to the other to form loops of cord material along the opposite side edges of the mop head over a predetermined length, securing said mop cords together by stitching said cords along plural rows extending lengthwise of the mop toward the ends of the length thereof for securing said mop cords together to provide a length of cord material, cutting the cord material to the desired length, securing a fabric backing to the cord material, bringing the ends of the mop head together with the fabric backing on the inside, turning the ends of the mop head back to expose the ends of the fabric backing for use as a headband, securing the turned back ends of the cord material and fabric backing together to form a closed loop with such loops of cord material along the opposite side edges thereof, and providing means on the cord material for attachment to a handle.

29. The method of claim 28 wherein the turned back ends of the mop head are secured together adjacent the sides only of the fabric backing to provide a pocket therebetween for receipt of a portion of a handle attachment device therebetween.

30. The method of claim 28 wherein the fabric backing is secured to the entire length of the cord material.

31. The method of claim 28 wherein the fabric backing is secured only to the ends of the cord material.

* * * * *